US005889543A

United States Patent [19]

Miyazawa et al.

[11] Patent Number: 5,889,543

[45] Date of Patent: Mar. 30, 1999

[54] INK TANK

[75] Inventors: Hisashi Miyazawa; Munehide Kanaya, both of Nagano, Japan

[73] Assignee: Seiko Epson Corporation, Tokyo, Japan

[21] Appl. No.: 701,597

[22] Filed: Aug. 22, 1996

[30] Foreign Application Priority Data

Aug. 23, 1995 [JP] Japan ..... 7-237613

[51] Int. Cl.[6] ..... B41J 2/175

[52] U.S. Cl. ..... 347/86

[58] Field of Search ..... 347/86, 87, 30, 347/85

[56] References Cited

U.S. PATENT DOCUMENTS

| | | | |
|---|---|---|---|
| 4,079,384 | 3/1978 | Takano et al. | 347/86 |
| 4,383,263 | 5/1983 | Ozawa et al. | 347/30 |
| 4,571,599 | 2/1986 | Rezanka | 347/87 |
| 5,182,581 | 1/1993 | Kashimura et al. | 347/87 |

FOREIGN PATENT DOCUMENTS

| | | |
|---|---|---|
| 0 519 452 A2 | 12/1992 | European Pat. Off. . |
| 0 570 981 A1 | 11/1993 | European Pat. Off. . |
| 56-67269 | 6/1981 | Japan . |
| 1-244862 | 9/1989 | Japan . |
| 5338198 | 12/1993 | Japan . |

*Primary Examiner*—N. Le
*Assistant Examiner*—Michael Nghiem
*Attorney, Agent, or Firm*—Stroock & Stroock & Lavan LLP

[57] ABSTRACT

A piston is slidably arranged in an ink chamber designed to communicate with a recording head through an ink passage. The pressure inside the ink chamber is kept to a predetermined negative pressure at all times by taking advantage of the tare of the piston. As a result of this construction, leakage of the ink from a recording head can be prevented independently of the ink tank mounting position or temperature fluctuations.

6 Claims, 3 Drawing Sheets

INK TANK

BACKGROUND OF THE INVENTION

1. Field of the Invention

The invention relates to an ink tank to be used for printers of the type that makes a recording using liquid ink such as ink-jet printers.

2. Related Art

In an ink tank of a type that is mounted on a carriage so as to communicate with a recording head, various measures have been given to check leakage of ink brought about by ink tank mounting position and the expansion of gases in the ink.

An ink tank proposed by the present applicant in Unexamined Japanese Patent Publication No. Sho. 56-67269 is given such a measure. A negative pressure produced within the tank is balanced with the surface tension of the ink at the tip of a nozzle at all times by deforming the ink tank so as to expand from within by a spring arranged inside the ink tank. Since the ink tank of this type requires that the tank itself be deformed to expand, not only there is a restriction on how the ink tank is mounted on the carriage, but also there is room for improvement with respect to the problem that the ink might leak from the nozzle due to contact with other objects at any moment.

SUMMARY OF THE INVENTION

The invention has been made in view of the aforementioned problems. The object of the invention is therefore to provide a novel ink tank that has no restriction on the mounting position of the ink tank or the like and that can check leakage of the ink reliably.

To achieve the above object, the invention is applied to an ink tank in which an ink passage is arranged on one side of a vertically extending boxlike ink tank in such a manner that the ink passage communicates with the ink tank at an upper portion thereof, the ink tank having an opening communicating with outside air on a lower end portion thereof, and in which a piston is slidably arranged inside the ink tank, the piston making the ink tank negatively pressured by a tare thereof.

According to the invention, the piston is arranged so as to be vertically movable in the ink tank that communicates with the recording head through the ink passage. Therefore, not only the ink tank is kept negatively pressured at all times by the tare of the piston so that leakage of the ink from the nozzles can be prevented independently of the ink tank mounting position and the expansion of gases in the ink tank, but also the negative pressure within the ink tank can be maintained constant at all times by allowing the piston, with the vertical movement thereof, to absorb internal pressure fluctuations.

In addition, by causing the respective openings arranged on the lower end of the ink passage and the bottom plate of the ink tank through the porous member, outside air can be introduced into the ink passage through the porous member when there is no ink in the ink tank, thereby allowing all the ink remaining in the ink passage to be used up. Moreover, when the check valve is arranged along the communicating section of the ink passage that communicates with the ink tank, leakage of the ink from the ink supply section or the like can be prevented even if the ink tank is removed and put upside down.

DETAILED DESCRIPTION OF THE PREFERRED EMBODIMENTS

Embodiments of the invention will now be described.

Figure 1:
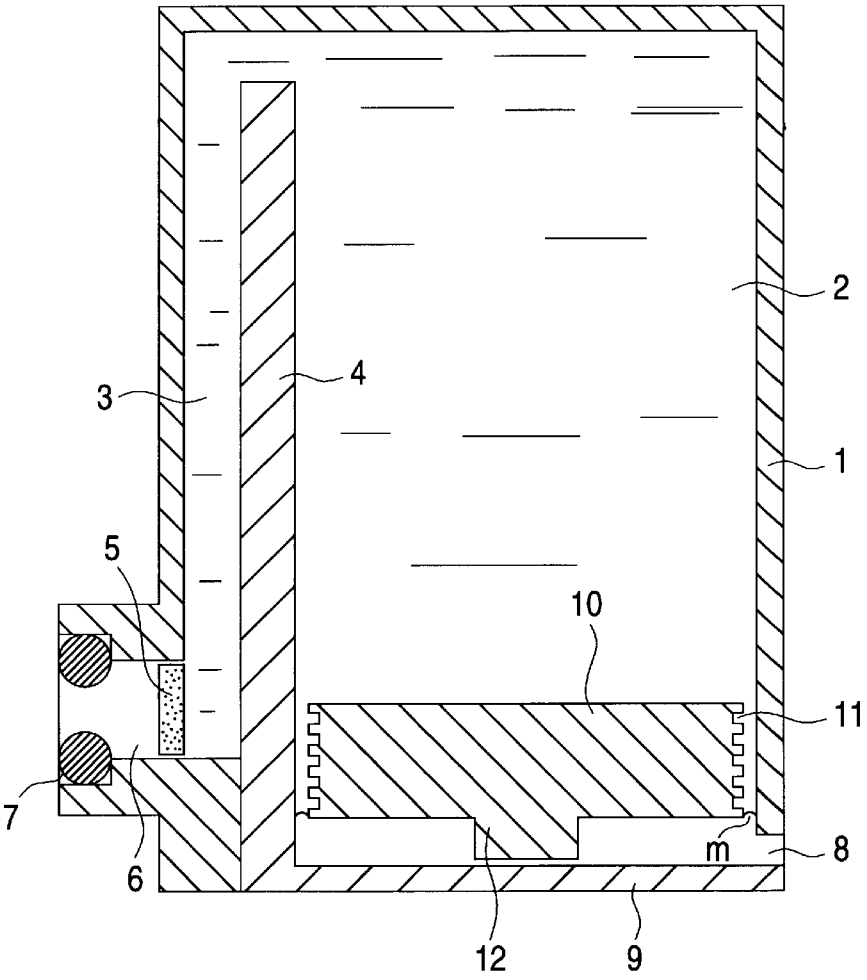
FIG. 1 are sectional views of an ink tank, which is an embodiment of the invention with a view (a) showing a state in which the ink tank is full of ink and with a view (b) showing a state in which the ink tank is empty.
Figure 1:
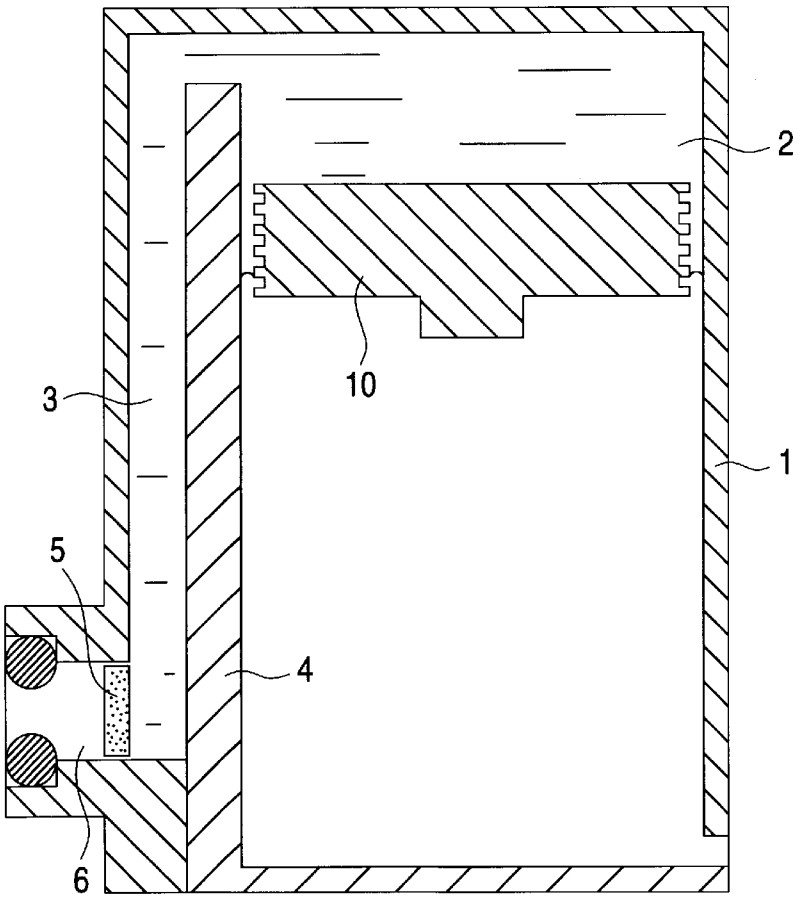

FIG. 1 shows a first embodiment of the invention.

An ink tank denoted as reference numeral 1 in FIG. 1 is formed to a vertically extending boxlike body, and the inside of the ink tank 1 is divided into an ink chamber 2 and an ink passage 3 through a vertically extending partition 4. A piston 10, which will be described later, is arranged in the ink chamber 2 so as to be vertically slidable therethrough. Further, the ink passage 3 that communicates with the upper end of the ink chamber 2 communicates with an ink supply hole 6 that is arranged on one side of the ink tank 1, so that ink within the ink chamber 2 is supplied to a not shown recording head through a needle inserted into the ink supply hole 6.

The ink tank 1 is constructed in the following manner. The piston 10 is vertically moved smoothly by means of air communication through an air hole 8 arranged on the bottom end. Further, the piston 10 forms a meniscus m in the ink between several grooves 11 ···· arranged around the circumferential surface thereof and the inner wall of the ink chamber 2, so that the piston 10 can produce a predetermined negative pressure within the ink chamber 2 by its own weight while holding the ink within the ink chamber 2 through the meniscus m. Still further, on the lower surface of the piston 10 is a projection 12. The projection 12 is formed so as not to close the air hole 8 even if the piston 10 is positioned at the lower end of the ink chamber 2.

It may be noted that reference numeral 5 denotes a porous body arranged so as to close the ink supply hole 6 and that reference numeral 7 denotes a packing.

In the thus constructed embodiment, the piston 10 is positioned at the lowermost end so as to cause the projection 12 thereof to come in contact with a bottom plate 9 as shown in FIG. 1(*a*) with the ink chamber 2 full of ink. Under this condition, the ink within the ink chamber 2 is held by the meniscus m of the ink formed between the grooves 11 arranged around the circumferential surface of the piston 10 and the inner wall of the ink chamber 2.

Since a plurality of grooves 11 ···· are arranged around the circumferential surface of the piston 10 in this embodiment in particular, meniscuses m to be formed in one stage to another contribute to checking leakage of the ink even if a meniscus m in the first stage is broken by vibrations accompanied by the shuttling of the carriage.

Under this condition, when the needle on the rear end of the recording head has been inserted into the ink supply hole 6 and a predetermined recording operation has been performed with the ink tank 1 mounted on the not shown carriage, the piston 10 positioned at the lowermost end is gradually elevated by the negative pressure within the ink chamber 2 produced by the consumption of the ink while resisting its own weight, so that the negative pressure is kept constant within the ink chamber 2 at all times.

The negative pressure equivalent to the weight of the piston 10 acts on respective nozzles of the recording head via the ink supply hole 6, checking leakage of the ink from the nozzles while sucking the ink in the nozzles slightly backward.

It may be noted that even if the ink tank 1 is removed from the carriage during operation, the ink chamber 2 can be kept at a negative pressure by making the meniscus in the porous body 5 stronger than the negative pressure produced by the piston 10.

As the ink is further consumed, the piston 10 elevates within the ink chamber 2 as shown in FIG. 1(*b*) and finally stops supplying the ink by reaching the top plate of the ink chamber 2.

By the way, the aforementioned embodiment is characterized in that the negative pressure within the ink passage 3 increases with increasing consumption of the ink after the piston 10 has reached the upper end of the ink chamber 2. Hence, an amount of ink substantially equivalent to the capacity of the ink passage 3 is not allowed to be consumed.

Figure 2:
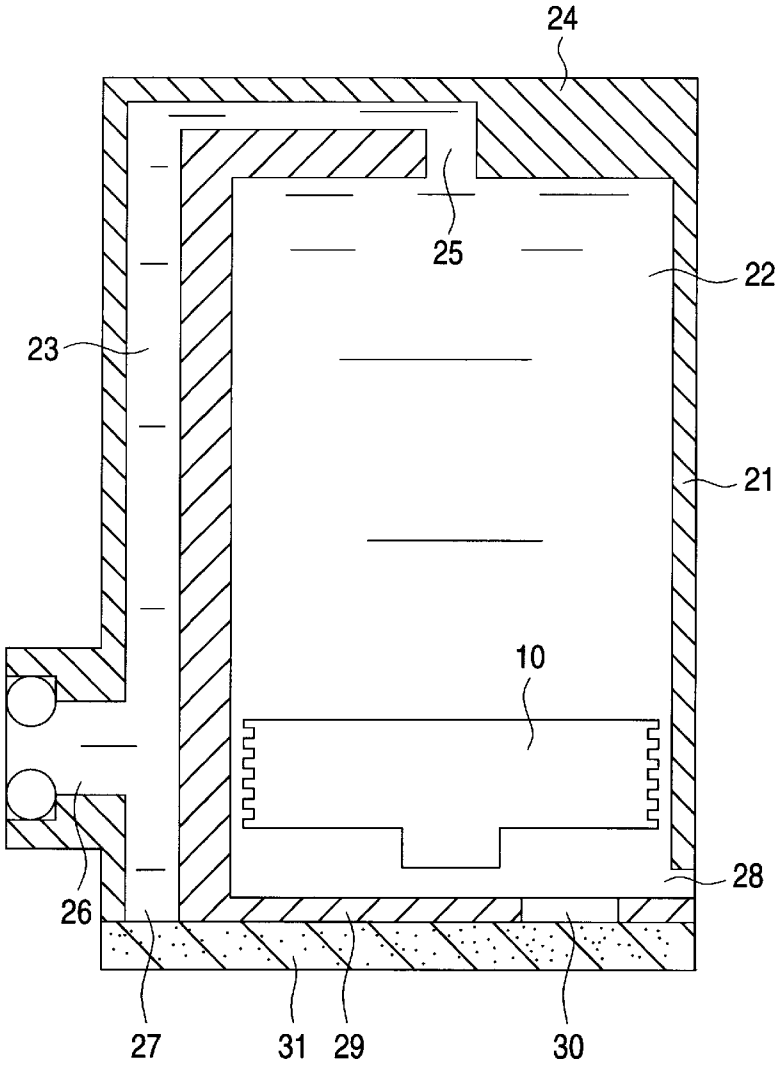
FIG. 2 are sectional views of an ink tank, which is a second embodiment of the invention with a view (a) showing a state in which the ink tank is full of ink and with a view (b) showing a stat in which the ink tank is empty.
Figure 2:
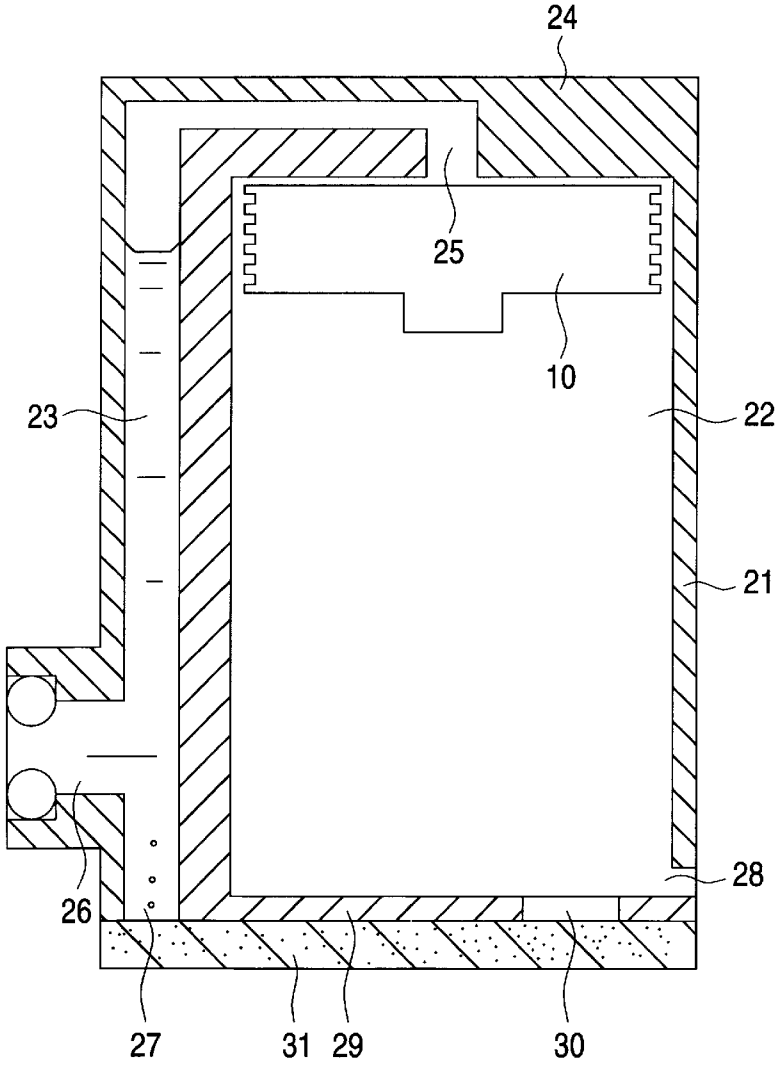

An embodiment shown in FIG. 2 has been made to overcome this problem in particular. In an ink tank 21, not only an opening 25 on the upper end of an ink passage 23 faces an ink chamber 22 from a part of a top plate 24, the ink passage communicating with an ink supply hole 26, but also openings 27, 30 are arranged on the lower end of the ink passage 23 and on a bottom plate 29 of the ink chamber 22, respectively and these openings 27, 30 communicate with each other through a porous member 31 stuck to the lower surface of the bottom plate 29. It may be noted that reference numeral 28 denotes an air hole arranged on one side on the lower end of the ink chamber 22.

In this embodiment, the negative pressure produced within the ink chamber 22 by the tare of the piston 10 acts also on the lower end opening 27 through the ink passage 23. However, since the porous member 31 facing the opening 27 is impregnated with ink, the meniscus of the ink formed in the porous member 31 does not allow outside air to enter into the ink passage 23 via the bottom plate opening 27 even if the negative pressure does act on the porous member 31.

When the ink within the ink chamber 22 has been used up and the opening 25 on the upper end of the ink passage 23 has been closed by the piston 10 being brought into contact with the top plate 24, the negative pressure produced as ink droplets are jetted for recording gradually increases. When the negative pressure reaches to a certain level, the meniscus of the ink within the porous member 31 breaks. As a result, the outside air equivalent to the amount of ink consumed flows into the ink passage 23 via the bottom plate opening 27, which in turn allows all the ink remaining in the ink passage 23 to be used up.

The invention is characterized as checking leakage of the ink from the nozzles by keeping the ink chamber 2 negatively pressured while taking advantage of the tare of the piston 10. However, in the case where the ink tank 1 is removed from the carriage and mounted upside down, the pressure within the ink chamber 2 increases with the tare of the piston 10 that acts reversely, which in turn causes the ink inside the ink chamber to leak from the ink supply hole 6.

Figure 3:
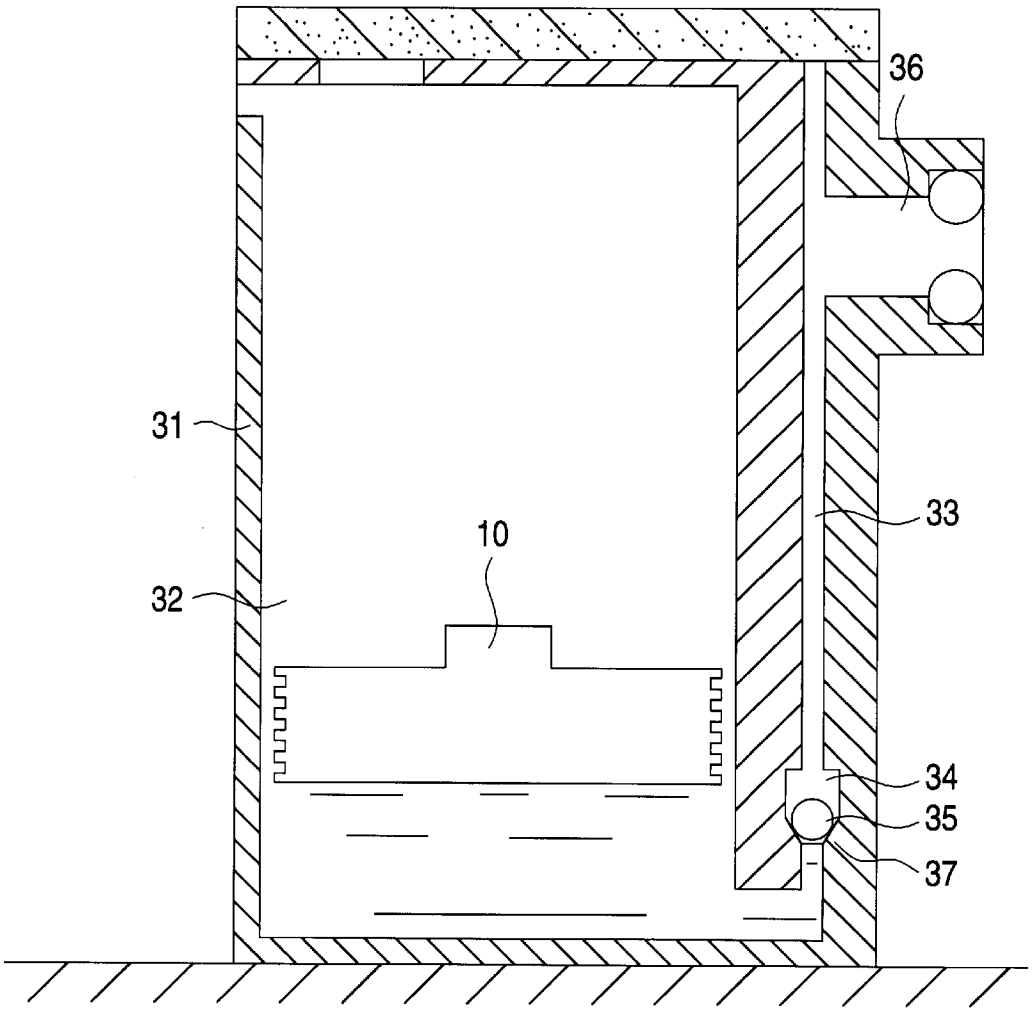
FIG. 3 is a sectional view of an ink tank, which is a third embodiment of the invention.

FIG. 3 shows a third embodiment of the invention that is designed to control the aforementioned phenomenon. That is, an ink tank 31 in the third embodiment has a valve chamber 34 arranged on the upper end of an ink passage 33 that communicates with an ink chamber 32, and when the ink tank 31 is put upside down as shown in FIG. 3, a ball valve 35 within the valve chamber 34 is seated on a valve seat 37 so that the ink passage 33 can be closed.

In this embodiment, the ink passage 33 is closed only when the ink tank 31 is put upside down, so that even if the pressure within the ink chamber 32 is increased by the tare of the piston 10, the pressure is kept from acting on the ink passage 33 to thereby check leakage of the ink.

Figure 4:
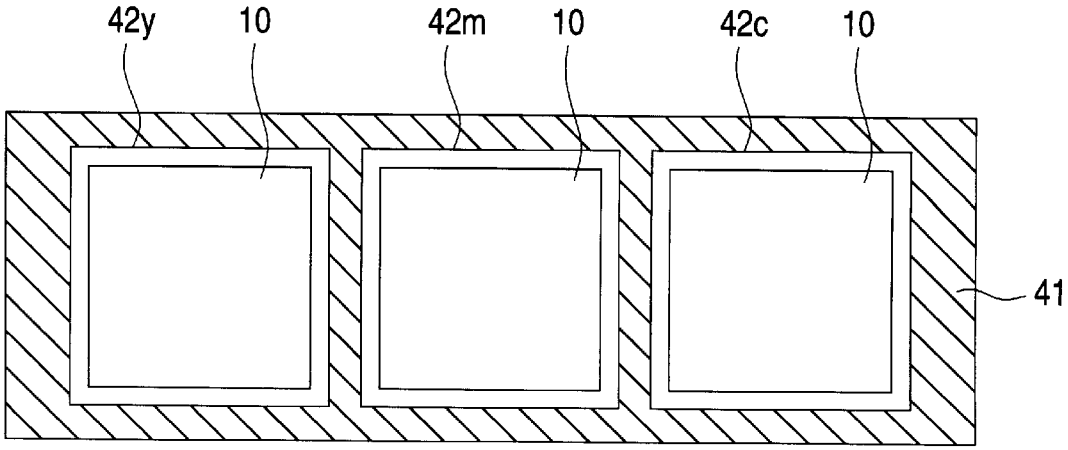
FIG. 4 is a top view showing an ink tank to be applied to a color printer, which is still another embodiment of the invention.

On the other hand, since the invention is designed to hold the ink by forming a meniscus between the piston and the inner wall of the ink chamber, required tolerances with which to machine the piston are not so high. FIG. 4 shows an embodiment designed to downsize as much as possible the ink tank that contains yellow, magenta, and cyan inks for a color printer by taking advantage of low machining tolerances.

That is, in this embodiment, ink chambers 42*y*, 42*m*, 42*c* arranged in a common ink tank 41 are formed to be boxlike, and pistons 10*y*, 10*m*, 10*c* to be slidably arranged in the respective ink chambers 42*y*, 42*m*, 42*c* are also formed to be boxlike. As a result of this construction, the space for arranging the ink tank 41 with respect to the capacity of the ink can be minimized.

In the embodiment described above, the piston and the ink chamber are configurated to be square or rectangular shaped as viewed from the top in consideration of the space efficiency in a case where three pistons and three ink chambers are arranged for three colors of ink. However, the present invention is not limited thereto or thereby. For example, the piston and the ink chamber may be circular or oval shaped as viewed from the top.

According to the invention as described in the foregoing, the piston is arranged so as to be vertically movable in the boxlike ink tank that communicates with the recording head through the ink passage. Therefore, not only the ink tank is kept negatively pressured at all times by the tare of the piston so that leakage of the ink from the nozzles can be prevented independently of the ink tank mounting position and the expansion of gases in the ink tank, but also the negative pressure within the ink tank can be maintained constant at all times by allowing the piston, with the vertical movement thereof, to absorb internal pressure fluctuation.

In addition, by causing the respective openings arranged on the lower end of the ink passage and the bottom plate of the ink tank through the porous member, outside air can be introduced into the ink passage through the porous member when there is no ink in the ink tank, thereby allowing all the ink remaining in the ink passage to be used up. Moreover, when the check valve is arranged along the communicating section of the ink passage that communicates with the ink tank, leakage of the ink from the ink supply section or the like can be prevented even if the ink tank is removed and put upside down.

What is claimed is:

1. A vertically extending ink tank, said ink tank comprising:

a partition extending vertically within said ink tank, said partition, forming an opening at an end thereof;

an ink chamber disposed in said ink tank;

an ink passage disposed in said tank, said partition disposed between said ink chamber and said ink passage, said ink passage being in fluid communication with said ink chamber through said opening;

an ink supply hole disposed in said ink passage; and a piston slidably disposed in said ink chamber, said piston making the ink tank negatively pressured, said piston having a circumferential surface, and said circumferential surface and at least said partition being separated by a gap.

2. An ink tank according to claim 1, further comprising a bottom plate, the bottom plate forming a portion of said ink chamber and said ink passage, a porous member affixed to said bottom plate, a second opening formed in said bottom adjacent to said ink passage and a third opening formed in said bottom plate adjacent to said ink chamber, said second and third openings communicating with said porous member; said ink passage and said ink chamber being in communication with each other through said porous member.

3. An ink tank according to claim 1, further comprising a check valve disposed in said ink passage such that the weight of said check valve preventing ink from flowing from said ink passage into said ink chamber.

4. An ink tank according to claim 1, wherein the ink tank and the piston arranged within the ink tank are formed so as to be square or rectangular as viewed from top.

5. An ink tank according to claim 1, wherein at least a groove is formed around said circumferential surface of the piston to form a meniscus of ink at least between said piston and said partition wall of the ink tank.

6. The ink tank of claim 1, further comprising an air hole formed in said ink tank to provide fluid communication between said ink chamber and outside air.

* * * * *